United States Patent [19]

Mula

[11] Patent Number: 4,850,907

[45] Date of Patent: Jul. 25, 1989

[54] AIR MOTOR SYSTEMS FOR SMALL BOATS

[76] Inventor: Joe Mula, 711 Zanzibar Ct., San Diego, Calif. 92109

[21] Appl. No.: 59,325

[22] Filed: Jun. 8, 1987

[51] Int. Cl.[4] ..... B63H 16/00; B63H 7/00; F01B 3/10

[52] U.S. Cl. ..... 440/23; 91/483

[58] Field of Search ..... 440/21, 23; 60/412; 91/476.6; 92/72

[56] References Cited

U.S. PATENT DOCUMENTS

| | | | |
|---|---|---|---|
| 1,268,816 | 6/1918 | Buckner | 60/412 |
| 1,964,245 | 6/1934 | Benedek | 92/72 |
| 2,326,464 | 8/1943 | Jones | 91/481 |
| 2,556,619 | 6/1951 | Hearon | 440/23 |
| 2,983,244 | 5/1961 | Young | 440/23 |
| 3,046,950 | 7/1962 | Smith | 91/491 |
| 3,118,420 | 1/1964 | Hickson | 440/23 |
| 3,179,016 | 4/1965 | Thornton-trump | 91/481 |
| 3,344,715 | 10/1967 | Wilson | 92/72 |
| 3,874,270 | 4/1975 | Purcell | 91/481 |
| 3,998,052 | 12/1976 | Easter | 60/413 |
| 4,108,049 | 8/1978 | Lawson | 91/478 |

FOREIGN PATENT DOCUMENTS

| | | | |
|---|---|---|---|
| 293169 | 5/1966 | Australia | 91/491 |
| 2926783 | 1/1981 | Fed. Rep. of Germany | 92/72 |

*Primary Examiner*—William L. Freeh

*Attorney, Agent, or Firm*—Frank D. Gilliam

[57] ABSTRACT

An air motor for small manually powered recreational boats. The overall system includes a manually powered pump which supplys pressurized air to accumulator tanks through check valves, a throttle to pass selected quantities of pressurized air from the tanks to an air motor, and the motor which converts the air pressure to rotational motion which drives an underwater propellor to move the boat. The air motor includes at least two sets of valves and power piston assemblies. A control cam and a power cam are mounted on a rotatable crankshaft which also drives the propellor. The control cam actuates the valves to direct air therefrom in a properly timed sequence. The power piston rods press on the power cam (functioning as a lever arm) to cause rotation of the crankshaft. This air motor assembly is compact, lightweight, smooth running and energy efficient.

2 Claims, 3 Drawing Sheets

FIGURE 5
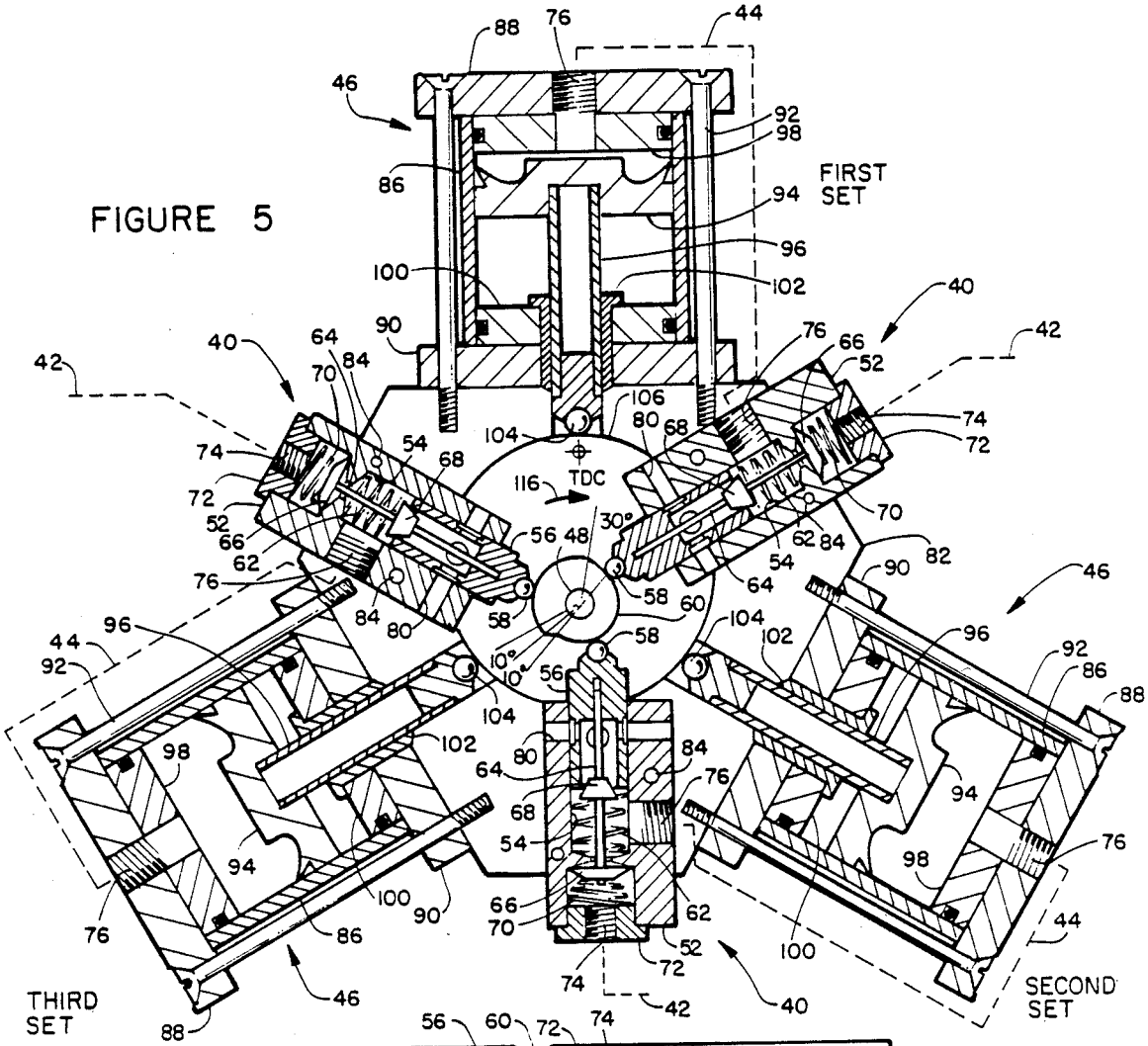
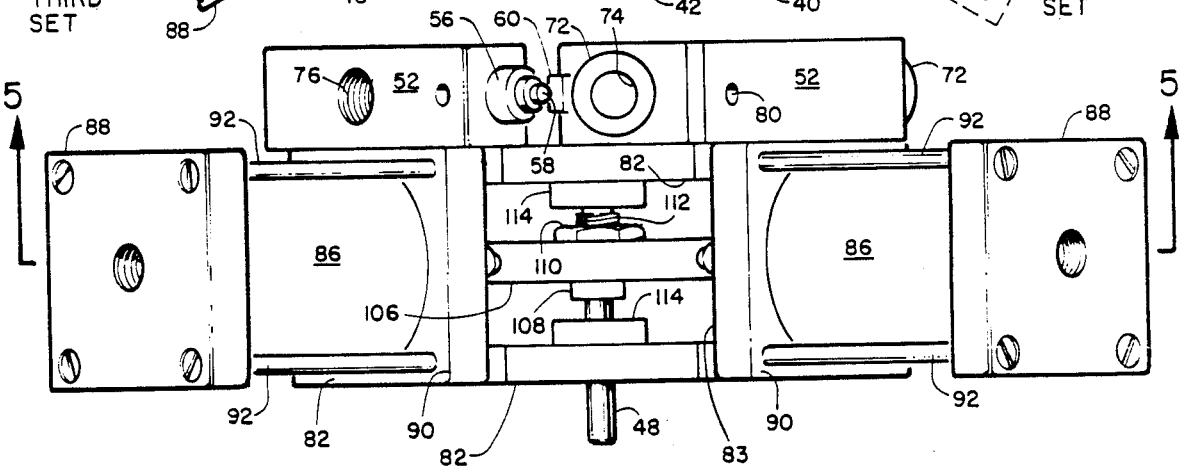
FIGURE 4

AIR MOTOR SYSTEMS FOR SMALL BOATS

BACKGROUND OF THE INVENTION

This invention relates in general to energy conversion systems and, more particularly, to an air motor system for driving small recreational boats.

Manually-powered small boats have long been used for transportation and recreation. Many such boats are powered by oars, paddles or the like. These like methods are not convenient for the occasional recreational user, since they require considerable skill and a high, constant work output. Later, "paddle boats" were developed using large side or rear-mounted paddle wheels driven by the operators hands or feet through mechanical crank systems. Direct manual drive of a propeller was also attempted, as described by Willis in U.S. Pat. No. 636,479. While these require less skill to operate, they are still energy-inefficient and require a constant input of manual energy to keep the boat in motion.

A number of air drive systems have been developed in order to reduce the need for constant word and to improve systems inefficiency. These systems use a manual air compression systems, such as hand or foot driven piston-type air pumps, a tank to accumulate the pressurized air into rotary motion at an underwater propeller. These permit the operator to build up pressure, then rest while the propeller continues to operate on stored energy for a period.

Typical of these prior air drive systems are those described by Crowe in U.S. Pat. No. 808,346 and Smith in U.S. Pat. No. 453,217. While these early air drive mechanisms are apparently workable, they are mechanically complex, heavy and inefficient, particularly in using turbines to convert air pressure to rotary motion. Turbines tend to be very inefficient at the low rotational speeds involved in such boats.

Other manual boat drives include directly coupled manual pump means driving a water jet as described by Ch'iu in U.S. Pat. No. 3,487,806 and the direct pedal operated fluid drive described by Sever et al in U.S. Pat. No. 2,720,185. Again, these have disadvantages in requiring constant effort to keep the boat in motion and inefficient energy conversion.

Thus, there is a continuing need for energy efficient, compact and lightweight manual drive systems for small recreational boats which allow the accumulation of energy to permit the operator to rest for periods while continuing to operate the boat and in particular for improved air motors suitable for use in such systems.

SUMMARY OF THE INVENTION

The above-noted problems, and others, are overcome by this invention, which basically includes a novel air motor useful in a system which includes a manual pump for compressing air and directing it to a tank for accumulation, at throttle for selectively varying the quantity of air passing to the air motor for varying speed and a propeller drive means for taking the rotational energy produced by the air motor and driving the boat through the water.

The air motor comprises at least two (preferably three) sets of control valve assemblies and power cylinders, each of which includes a piston slidable within the cylinder and having an output piston rod. A crankshaft is provided, one end or which acts as the power output connection to the propeller drive, having mounted thereon a control cam which operates the valves and a power cam which receives dynamic power from the power cylinders. The control cam is configured so as to sequentialy direct air form the tank to the power cylinder to push the piston rod against the power cam and to exhaust air form the cylinder during the exhaust stroke. The several valve and cylinder pairs operate in an overlapping sequence producing a smooth and steady flow of power to the propeller.

BRIEF DESCRIPTION OF THE DRAWING

Details of the Invention, and of certain preferred embodiments thereof, will be further understood upon reference to the drawing, wherein:

FIG. 4 is an elevation view of my air motor assembly;

FIG. 5 is a section view of my air motor assembly, taken on line 5—5 in FIG. 4;

DETAILED DESCRIPTION OF PREFERRED EMBODIMENT

Figure 1:
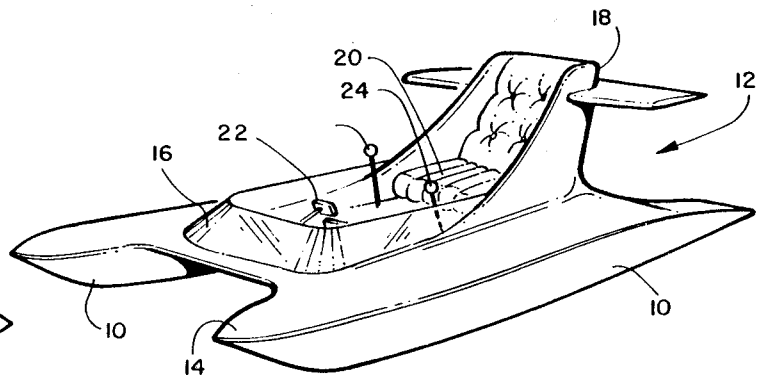
FIG. 1 is a perspective view of a boat of the sort which can advantageously utilize my air motor assembly.

Referring now to FIG. 1, there is seen a perspective view of a typical recreational boat in which the air motor drive assembly of my invention can be effectively utilized. Of course, the boat could have other shapes and uses. For example, the boat could be configured to carry multiple passengers with multiple manual pump means if desired, or the boat could be used for other purposes, such as a dingy for a large vessel, fishing, etc. The configuration shown is especially suitable for illustrating a preferred application of my air motor system.

The boat of FIG. 1 includes two spaced hulls 10 having their upper surfaces closed by a superstructure 12 which includes a deck 14, a cowl 16 and a seat structure 18. The operator sits on seat 20 in a position such that his feet naturally and comfortably rest on a pair of pedals connected to air pumps as detailed below. Seat 20 may be adjustable in a force-and-aft direction to accommodate different operators. A throttle lever 24 is provided for controlling speed, as discussed below. A steering wheel 24 or the like may be provided for steering the boat through a conventional rudder (not shown) or by rotating the axis of the propeller in a conventional manner.

Figure 2:
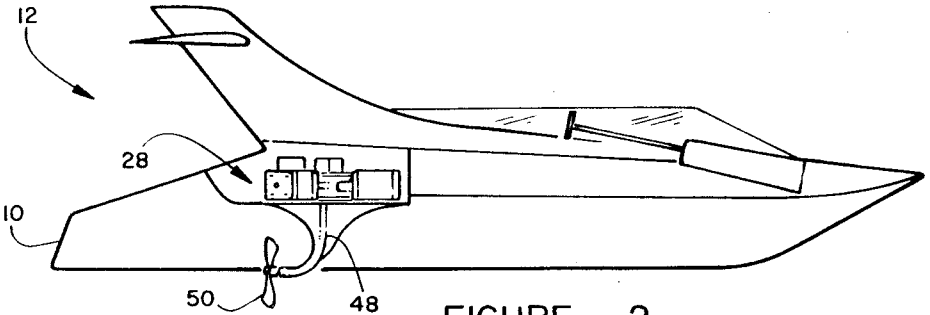
FIG. 2 is an elevation view of the boat of FIG. 1, partially cut-away, showing the components of the air motor assembly.
Figure 3:
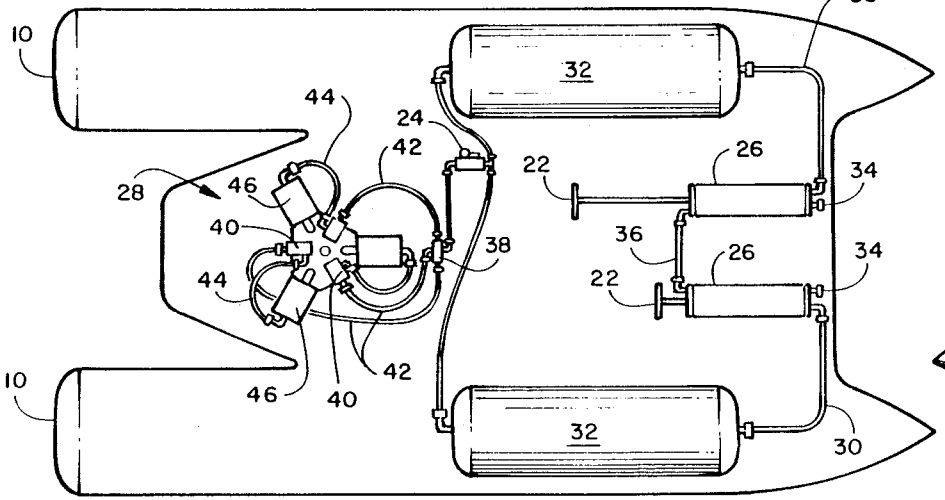
FIG. 3 is a plan view of the boat of FIG. 1 with the superstructure removed to reveal the internal components.

The overall arrangement of the drive system is schematically illustrated in FIGS. 2 and 3. FIG. 2 is a side elevation view with the near hull 10 removed to expose the internal components. In the plan view of FIG. 3, the superstructure 12 is removed for the same reason.

A pair of cylinders 26 are manually driven to compress air for driving air motor 28. Each cylinder 26 includes a piston (not seen) which reciprocates within the cylinder in response to pressure on pedals 22. Output lines 30 carry pressurized air from cylinders 26 to tanks 32 located in hulls 10. Check valves prevent air from tanks from reentering cylinders 26.

A crossover line 36 connects cylinders 26 behind the pistons. As one pedal is pushed into its cylinder, a vacuum is created behind the piston. This is transmitted through crossover line 36 to the other cylinder as a suction which pulls that piston and pedal back to the outermost position. Thus, after each pedal is pushed in, it automatically moves back out when the other pedal is pushed.

Pressurized air produced by cylinders 26 is accumulated in tanks 32. If desired, the operator could "pump up" the tanks before starting out. Or, a shore-based source of air, such as an electronically powered compressor, could be used to pressurize tanks 32 through conventional tire valve stems (not shown) prior to beginning a trip in the boat. Then, the operator would only need to operate pedals 22 occasionally to keep pressure up.

To begin movement, the operator opens throttle valve 24 slightly, permitting pressurized air to flow from tanks 32 to air motor 28. Speed is controlled by varying the opening of throttle valve 24. The air passes through a fitting 38 which directs it to three valves 40 through lines 42. Valves 40 direct air flow in the proper sequence through lines 44 to power cylinders 46 which cause shaft 48 to rotate. Air motor 28 is described in detail below. Shaft 48 is connected to propeller 50 by any suitable power transmission means, such as a right-angle gear box or a flexible drive.

The boat may be steered through wheel 26 in any conventional manner, such as through a rudder or means to pivot propeller 50 about a vertical axis. In use, the operator may pump pedals 22 as necessary to keep the pressure in tanks 32 at a desired level. Because of the quantity of air stored, the operator need not pump at all times; instead he can pause to rest, fish, etc. without losing way.

Figure 6:
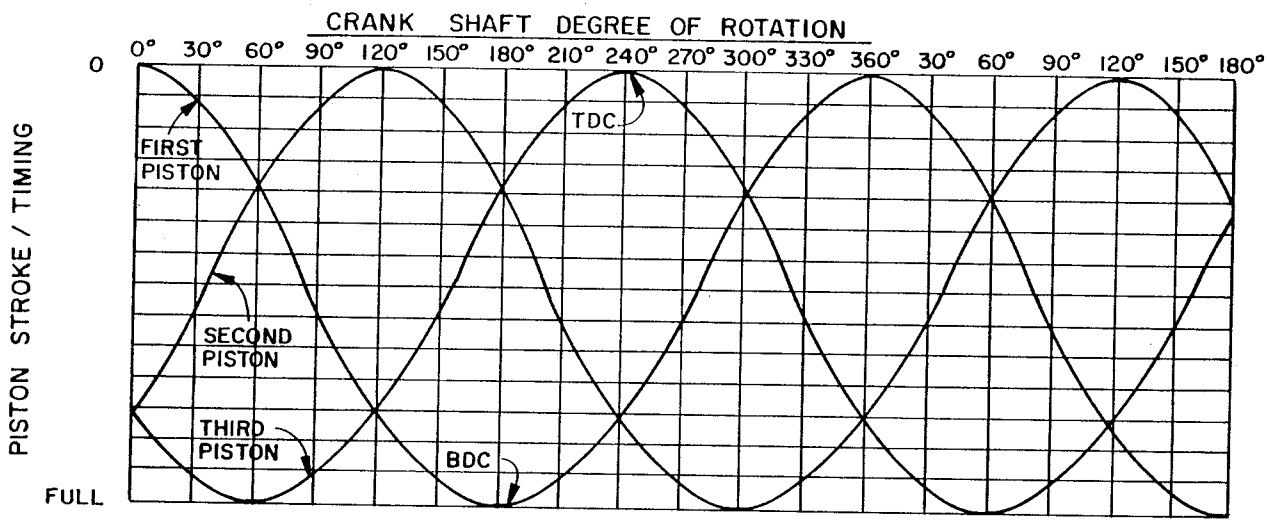
FIG. 6 is a chart illustrating the relative sequence of piston movement during operation.

Details of my air motor are provided in FIGS. 4 and 5. While any suitable number, two or more, pairs of control valves 40 and power cylinders 46 may be used, three as shown in the preferred arrangement for the optimum combination or power, smooth operation, light weight and compactness. If desired, two or more assemblies as shown in FIGS. 4 and 6 could be stacked, driving one shaft 48, or two or more assemblies could be used in one boat, each driving a separate propeller.

Each control valve 40 includes a housing 52 having a cylindrical bore 54 in which a piston 56 rides. The outer end of each piston 56 includes a rotatably mounted ball 58 acting as a cam follower to engage the surface of a control cam 60 under pressure provided by spring 62. A valve stem 64 carrying first and second valve disks 66 and 68 is axially movable within each piston 56 and is biased toward piston 56 by a spring 70 which bears against an end plug 72 closing the end of housing 52.

Air is admitted to each valve 40 through a line 42 (schematically indicated by a broken line for clarity) and valve inlet opening 74. When a first valve disk 66 is open (as seen in the upper left valve 40 in FIG. 5), air can pass through valve outlet opening and line 44 to cylinder opening 78.

When first valve disk 66 is in the closed position and second valve disk 68 is open (as in the lowermost valve in FIG. 5), exhaust air may pass back from cylinder opening 78, through line 44, valve opening 76 and out to the atmosphere through exhaust opening, which extends through the walls of housing 52 and piston 56.

When both first valve disk 66 and second valve disk 68 are closed (as seen in the upper right hand valve 40 in FIG. 5) air neither enters or leaves the valve, since the associated cylinder is at top dead center or bottom dead center and switching between power and exhaust strokes, as described in detail below. Each valve 40 is held to crankcase plates 82 by bolts (not seen) which pass through holes 84.

Each valve 40 controls the operation of a corresponding cylinder 46. Each cylinder includes a housing made up of a body 86 having a cylindrical bore, and top and bottom closures 88 and 90, respectively, all held together by a plurality of bolts 92 which pass through closures 88 and 90 and into crankcase 82. Within each bore a piston 94 with piston rod 96 is slidably positioned. Top and bottom sealing rings 98 and 100, respectively seal the bore against air leakage. Piston rods 96 slide in a sealed relationship in bushings 102. A rotatable ball 104 at the end of each piston rod 96 acts as a cam follower, riding against power output cam 106.

As best seen in FIG. 4, upper and lower crankcase plates 82 together with the cylinder bottom closures 90, form an enclosure, substantially surrounding crankshaft 48 and cam 106, which is mounted on a shoulder 108 on crankshaft 48 and held in place by a nut 110 threaded onto a threaded portion 112 of shaft 48. A pair of flanges 114 on crankshaft 48 hold the shaft in position between crankcase plates 82. Flanges 114 are held in place in any conventional manner, such as nuts on threaded portions of shaft 46, setscrews, pins or the like.

During the power stroke, as air pressure drives each piston 94 down, piston rods 96 through balls 104 drive cam 106 to rotate. Cam 106, which has an off-set, circular shape, functions as a lever arm. During each exhaust stroke, cam 106 pushes the piston 94 back, exhausting air from the cylinder. By properly sequencing the application of pressure to power cam 106, and varying the pressure through throttle 24, crankshaft 48 is rotated at the desired speed.

Figure 7:
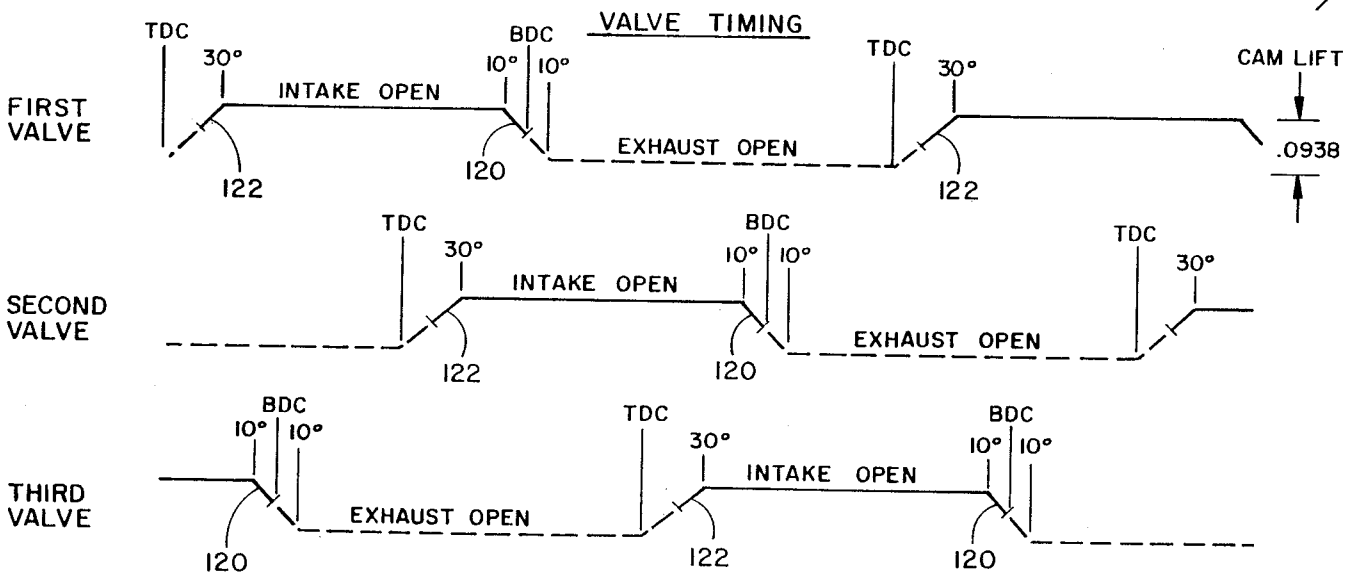
FIG. 7 is a schematic diagram illustrating the relative sequence of valve operation in conjunction with piston position as shown in FIG. 6.

Operation of the air motor 28 and the proper sequence of operation will be better understood upon reference to FIGS. 6 and 7. For the purpose of discussing these figures, the three pairs of valves 40 and cylinders 46 will be identified as first, second and third sets, starting with the uppermost set in FIG. 5 and moving clockwise.

As seen in FIG. 5, the cams 60 and 106 rotate in a clockwise direction as indicated by arrow 116. The cam follower 58 of first valve 40 is just entering a 30 ramp between top dead center (TDC) and the intake open mode (FIG. 7) as the first piston begins its stroke (FIG. 6.) In FIG. 5, the second valve is in the exhaust mode, approaching TDC and the third valve is in the power stroke, nearing bottom dead center (BDC). As seen at 120 in FIG. 7, the valve cam follower is halfway along a 20 ramp which assures a smooth transition between power and exhaust strokes. To assure that power is not applied too early, the intake fully opens only at about 30 past TDC as indicated at 122 in FIG. 7.

By following the charts and timing patterns of FIGS. 6 and 7 across, it can be seen that this valve and cylinder system operates smoothly, with at least one cylinder in the power mode at all times in the preferred three cylinder arrangement. If only two cylinders are used, there will be short transitional breaks in the application of power, making for rougher operation. Four or more sets of valves and cylinders could be used, if desired, but I have found that the additional weight and complexity is not necessary or desirable.

While certain specific arrangements, dimensions and components were detailed in the above description of preferred embodiments, those can be varied, where suitable, with similar results. For example, various other air pumping arrangements can be used and the air motor assembly could be used in a variety of other boats. Other variations, ramifications and applications of this invention will occur to those skilled in the art upon reading this disclosure. Those are intended to be included within the scope of this invention, as defined in the appended claims.

I claim:

1. An air motor drive system for small boats which comprises:

manually driven air pump means for compressing air;

storage means to accumulate said compressed air;

throttle means for infinitely varying the release of air from said storage means;

at least two power cylinder assemblies adapted to receive air from said throttle means, each including a piston means movable in response to air pressure directed thereagainst to apply mechanical pressure to a circular power cam eccentrically mounted on a crackshaft to rotate said crankshaft;

a control valve assembly associated with each power cylinder, each control valve assembly including valve means operatively connected to a cam follower means adapted to contact a control cam centrally positioned on said crankshaft and to direct air pressure from said throttle means to said power cylinder in accordance with the shape of said control cam; and means for direction said crankshaft rotation to a propeller.

2. The air motor drive system according to claim 1 wherein control valve assembly comprises:

a housing adjacent to said control cam;

a piston slidable toward and away from the control cam surface in a bore in said housing;

cam follower means on the end of said piston to ride along said cam surface;

means biasing said piston toward said cam surface;

first valve means within said housing adapted to permit air from an external source of pressurized air to pass to said power cylinder when said cam surface causes said cam follower to be a first distance from the cam axis and to prevent air from passing to said cam follower to be a second distance from the cam axis;

second valve means within said housing adapted to permit air to exhaust from said power cylinder when said cam surface causes said follower to be at said second distance from the cam axis and to prevent air from exhausting from said power cylinder when said cam surface causes said follower to be at said first distance from the cam axis;

said first and second valve means being adapted to both prevent flow of air to or from said power cylinder when said cam surface causes said follower to be at a distance intermediate of said first and second distances from the cam axis.

* * * * *